United States Patent [19]

Ernst et al.

[11] Patent Number: 4,811,178

[45] Date of Patent: Mar. 7, 1989

[54] HEADLIGHT FOR VEHICLES

[75] Inventors: Hans-Otto Ernst, Lippstadt; Herbert Cramer, Rüthen-Kallenhardt, both of Fed. Rep. of Germany

[73] Assignee: Hella KG Hueck & Co., Lippstadt, Fed. Rep. of Germany

[21] Appl. No.: 179,580

[22] Filed: Apr. 8, 1988

[30] Foreign Application Priority Data

Apr. 21, 1987 [DE] Fed. Rep. of Germany ..... 3713330

[51] Int. Cl.[4] ..... H01R 33/00

[52] U.S. Cl. ..... 362/226; 362/61

[58] Field of Search ..... 362/61, 80, 226

[56] References Cited

U.S. PATENT DOCUMENTS 4,670,822 6/1987 Baker ..... 362/226

FOREIGN PATENT DOCUMENTS 813619 5/1959 United Kingdom ..... 362/226

*Primary Examiner*—Allen M. Ostrager

*Attorney, Agent, or Firm*—Max Fogiel

[57] ABSTRACT

The opening in the bowl-shaped plastic reflector is surrounded by a collar. Inserted into the collar is an incandescent lamp with a flange that surrounds its base and rests against the face of the collar. The lamp is secured to the reflector with a wire spring that is bent along the optical axis into the shape of a U at the rear of the reflector. The two legs of the spring are tensioned against opposite sides of the collar. The free ends of the legs rotate in a mount. Another mount is positioned on the other side of the collar and has a projection that extends out more or less radially in relation to the optical axis of the reflector and creates an undercut. The web that connects the legs automatically snaps into the undercut. The web has a lever in the form of a bent-in eye that rotates when forced down along the optical axis around a section of the second mount that parallels the web of the spring.

11 Claims, 2 Drawing Sheets

HEADLIGHT FOR VEHICLES

Figure 1:
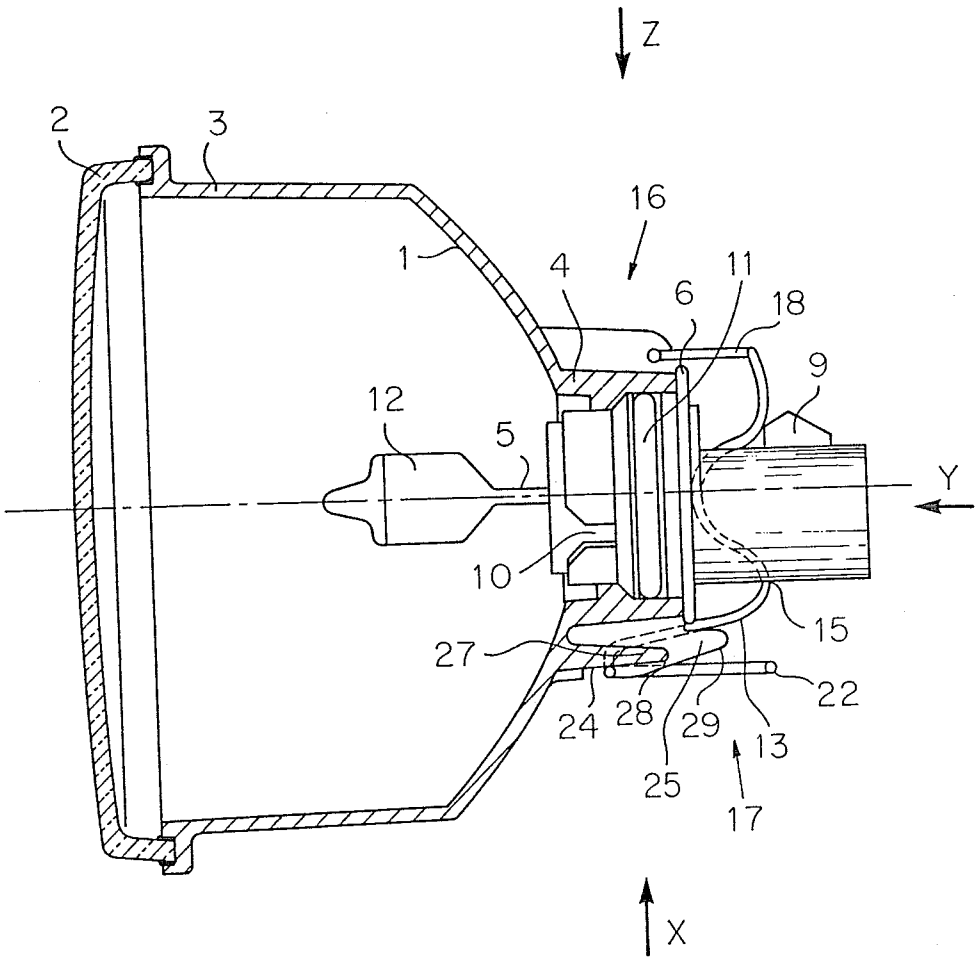

The invention concerns a headlight for vehicles with a bowl-shaped reflector made out of plastic and with an opening that accommodates an incandescent lamp surrounded by a collar that extends outward, whereby the lamp is inserted into the collar from the rear of the reflector with a flange around the base of the lamp resting against the face of the collar, whereby a wire spring is bent along the optical axis into the shape of a U on the rear of the reflector with its legs tensioned against opposites sides of the flange around the lamp, whereby the spring is secured to two mounts shaped onto the reflector at the other two opposite sides of the opening that accommodates the lamp, and whereby the first mount, which accommodates the free ends of the legs of the spring and which has an axis that extends across the legs, acts as a pivoting bearing and the second mount has an undercut at the rear that the spring automatically snaps into.

A headlight of this type is known from German AS No. 1 281 371. The base of the lamp that is inserted into the collar from the rear of the plastic reflector rests against the face of the collar. A mount for the wire spring that secures the lamp to the reflector is shaped onto the reflector at each opposite side of the collar. The spring is essentially bent into the shape of a U, and its two legs are tensioned against the two other opposite sides of the flange around the base of the lamp. The free ends of the spring are bent out and rotate in openings in one of the two mounts. The other mount is positioned between the two legs of the spring. Each side of the mount that faces the two legs has a projection that creates an undercut. The legs of the spring automatically snap into the undercuts. The tool employed to produce the reflector is complicated in design because it requires a separate adjustable component to obtain each undercut. Replacing the lamp is also very difficult and can only be done by an expert because the legs of the spring do not provide any purchase that would facilitate removal. This problem is even more difficult because there is usually not very much space on the rear of the headlight. The drawback is especially serious when the spring is to rest against the flange around the lamp subject to particularly high tension, a situation that does, however, ensure that the lamp will rest securely against the reflector and that any forces tending to extract a connector mounted on the base of the lamp can be counteracted. This advantage is to be retained in accordance with the invention.

The object of the invention is to modify a vehicle headlight of the aforesaid genus to the extent that the wire spring can be mounted and dismounted very rapidly and easily even when it rests against the flange around the lamp subject to high tension and when there is very little space on the rear of the reflector. The undercuts that constitute a structure for the spring to snap into are also to be applied to only one side of the mount.

This object is attained in accordance with the invention in that (a) the projection that creates the undercut in the second mount shaped onto the reflector to accommodate the spring extends at least to some extent radially to the optical axis of the reflector, (b) the web that connects the legs of the spring engages the undercut, (c) the web on the spring has a bent-in loop or eye that functions like a lever and is positioned more or less parallel to the optical axis and in the vicinity of the collar, (d) the second mount has a section that projects parallel to the web on the spring and that the lever rotates around toward the optical axis when compressed, and (e) the free end of the lever projects about half its length and preferably farther beyond the point that acts as a pivot.

In an embodiment of this type the ease with which the spring can be released from the undercuts increases with the length of the section of the lever on the spring that projects beyond the pivot.

In one practical development of the invention the first and/or second mount is shaped directly to the outside of the collar. This can be done with a reflector tool that is relatively simple in design.

In another practical development of the invention the second mount, which has the undercut, is shaped onto the reflector at some distance away from the collar. This measure allows the legs of the spring to be any desired length.

It is also practical for the bent loop or eye that functions as a lever to be shaped onto the midpoint of the web that connects the legs of the spring and to engage in conjunction with the two adjacent sections one undercut in the mount. Both legs of a spring of this type will, due to its symmetrical design, rest with the same force against the flange around the lamp, and the spring will not get caught or twisted while being released from the second mount.

Another advantage is obtained when the second mount for the spring is comprised of two separated columns that taper toward their free end and are connected by a wall, around the edge of which the spring can be pivoted against the face of the lever. This measure makes the mount very strong.

It is also practical for the sections of the leg adjacent to the web of the spring to rest against walls of the reflector that parallel the lever of the spring. These walls guide the spring during the assembly process and prevent the legs of the spring from springing out once they automatically snap into the second mount.

It is also practical for the legs of the spring to be long enough to allow the web that connects them to pivot over the contact tabs of the lamp or over a collar that surrounds and protects them. This measure makes it possible to employ a contact spring in accordance with the invention even when the contact tabs or protective collar are very long.

It is also practical for the midsection of the legs of the spring to be bent into the shape of a U and to be tensioned against the flange around the lamp. A contact spring of this type will have very satisfactory spring properties in that section.

The invention is illustrated in the drawing, wherein

Figure 3:
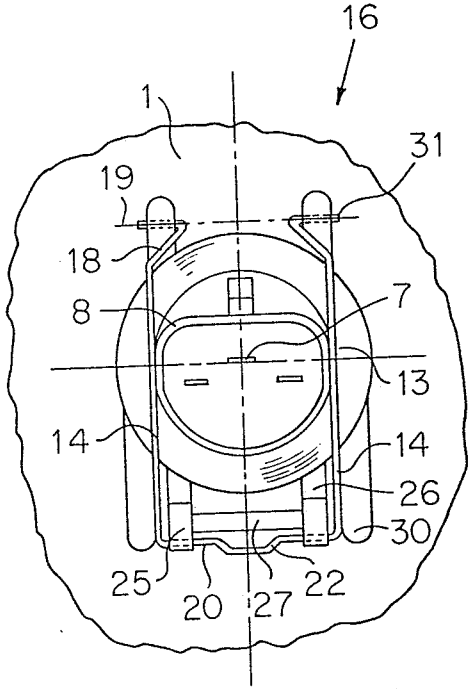
Figure 4:
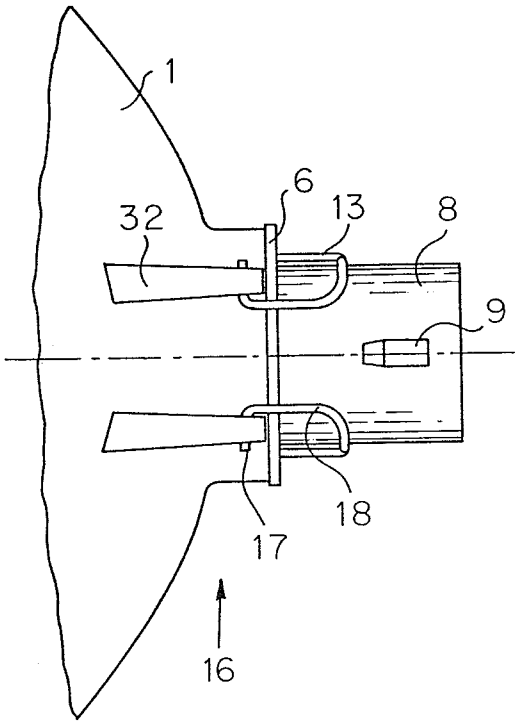
Figure 2:
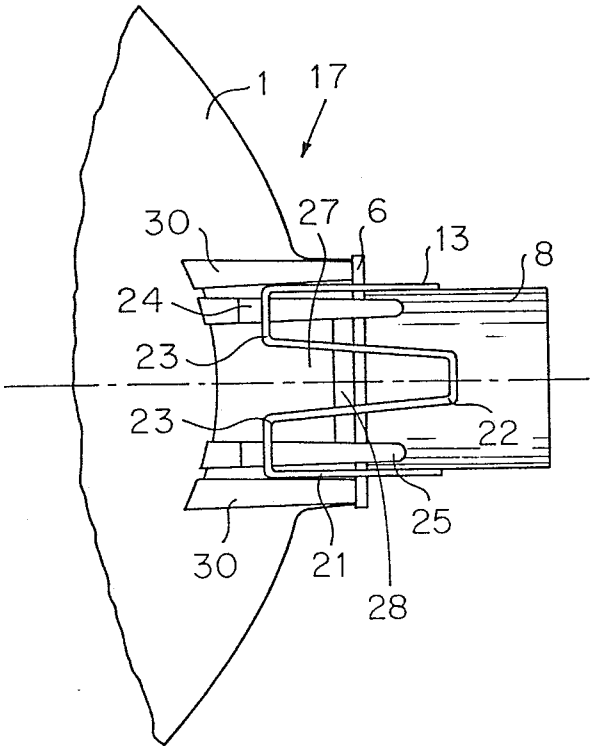

FIG. 1 is a vertical section through the middle of a headlight for motor vehicles, FIG. 2 is a view in the direction X, FIG. 3 a view in the direction Y, and FIG. 4 a view in the direction Z.

A headlight consists essentially of a parabolic reflector 1 made out of plastic and of a transparent cover 2 that seals the reflector. The cross-section of the beam of light emerging from reflector 1 is shaped into a square by straight upper and lower edges 3. At the vertex of parabolic reflector 1 is an opening that accommodates an incandescent lamp 5 and is surrounded by a collar 4. Lamp 5 is inserted against collar 4 from the rear of the headlight with a flange 6 that surrounds the base of the lamp resting against the face of the collar. The base is made out of plastic, and the end that extends out is provided with contact tabs 7 that are surrounded by a protective collar 8. A flattened side of protective collar 8 has a nose 9 that snaps into a connector (unillustrated) that rests against contact tabs 7. Three grooves 10 that parallel the direction the lamp is inserted in are positioned at the circumference of the end of the lamp base that faces the inside of the reflector. Extensions (unillustrated) on the collar engage the grooves to secure lamp 5. There is an annular groove in the surface of the base of the lamp that accommodates an annular seal 11 tensioned against the inside of collar 4. The face of the base that opposes the inside of the reflector supports the glass bulb 12 of lamp 5. Lamp 5 is axially secured to reflector 1 by a wire spring 13 that is tensioned against the flange 6 around the lamp. At the rear of reflector 1 spring 13 is bent into the shape of a U along the optical axis. Protective collar 8 is positioned between the legs 14 of the spring. The U-shaped midsection 15 of spring 13 is tensioned against the flange 6 around lamp 5. Spring 13 is secured to mounts 16 and 17 shaped onto reflector 1 at opposing sides of collar 4. Spring 13 pivots on the outwardly bent free ends 31 of its legs 14 on one mount 16. The free end 18 of the legs 14 on spring 13 is bent back toward the rear of reflector 1. The outwardly bent free ends 31 of spring 13 rotate in bores in two extensions 32 of first mount 16 shaped onto the rear and onto the outside of collar 4. The axis 19 that spring 13 pivots around extends across its legs 14. The sections 21 of legs 14 adjacent to the web 20 that connects the legs of the spring are bent toward the rear of the reflector. The midsection of web 20 has a lever 22 in the form of a bent-in eye. The sections 23 of the web adjacent to lever 22 each engage behind an undercut 24 in second mount 17. The undercuts 24 in second mount 17 are carried out in two separated columns 25 that taper toward their free end. Columns 25 are shaped onto reflector 1 at a distance from collar 4, and each is connected by a wall 26 to the outside of the collar. Another wall 27 connects columns 25, and its face has an edge 28 that parallels the web 20 of spring 13 and that lever 22 rotates around when it is forced along the optical axis. Edge 28, which acts as a pivot, extends about 2/3 of its total length over the free end of the lever. Rotating lever 22 around the pivot or edge 28 of second mount 17 rotates the sections 23 of the web 20 of spring 13 out of undercuts 24, subsequent to which the web, which connects legs 14, can be pivoted over the protective collar 8 around contact tabs 7. Lever 22 provides a purchase for mounting spring 13, with the sections 23 of web 20 adjacent to the lever sliding along sloping initial-accommodation surfaces 29 on the columns 25 on second mount 17 until they automatically snap into and engage the undercuts 24 on the columns. Second mount 17 is positioned and secured by means of two parallel walls 30 on the rear of the reflector, between which spring 13 is positioned with the sections 21 of legs 14 adjacent to web 20. The drawing illustrates only one of the possible positions of spring 13 and its mounts 16 and 17. The pivoting bearing for the spring could for example also be positioned below the lamp.

What is claimed:

1. A headlight for vehicles comprising: a bowl-shaped plastic reflector with an opening; and incandescent lamp with a base mounted in said opening and surrounded by an outwardly extending collar; a flange around said base of said lamp and nesting against a face of said collar, said lamp being inserted into said collar from the rear of said reflector; a U-shaped wire spring bent along the optical axis of said reflector and mounted on the rear of said reflector with legs of the U-shape tensioned against opposite sides of the flange around said lamp; first and second mounts shaped onto said reflector at two opposite sides of said opening within which said lamp is mounted for securing said spring; said first mount receiving free ends of the legs of said spring and having an axis extending across said legs, said first mount being a pivoting bearing; said second mount having an undercut at a rear side, said spring snapping automatically into said undercut; projection means forming said undercut and extending at least substantially radially to the optical axis of said reflector; web means connecting said legs of said U-shape and engaging said undercut; said web having a bent-in loop-shaped portion comprising a lever and positioned substantially parallel to said optical axis in vicinity of said collar; said second mount having a section projecting parallel to said web, said lever rotating toward said optical axis when compressed; said lever having a free end projecting at least half its length beyond a point comprising a pivot.

2. A headlight as defined in claim 1, wherein said first mount is shaped directly onto the outside of said collar.

3. A headlight as defined in claim 1, wherein said second mount is shaped directly onto the outside of said collar.

4. A headlight as defined in claim 1, wherein said first and second mounts are shaped directly onto the outside of said collar.

5. A headlight as defined in claim 1, wherein said second mount having an undercut is shaped directly onto said reflector at a predetermined distance from said collar.

6. A headlight as defined in claim 1, wherein said web means has a midpoint, said loop-shaped portion being shaped onto said midpoint, said web means engaging said undercut in said second mount with two adjacent sections.

7. A headlight as defined in claim 6, wherein said second mount is comprised of two separated columns having free ends, said columns tapering toward said free ends; wall means connecting said separated columns around an edge, said spring being pivotable at said edge against a face of said lever.

8. A headlight as defined in claim 1, wherein said legs have sections resting against walls of said reflector, said walls being parallel to said lever.

9. A headlight as defined in claim 1, wherein said lamp has contact tabs, said legs having a length so that said web means is pivotable over said contact tabs.

10. A headlight as defined in claim 1, wherein said legs have a length so that said web means is pivotable over said collar, said lamp having contact tabs surrounded protectively by said collar.

11. A headlight as defined in claim 1, wherein said legs have a midsection, said midsection being U-shaped and being tensioned against said flange around said lamp.

* * * * *